US010114332B2

(12) United States Patent
Takahashi et al.

(10) Patent No.: US 10,114,332 B2
(45) Date of Patent: Oct. 30, 2018

(54) OPENING-CLOSING MECHANISM AND IMAGE FORMING APPARATUS

(71) Applicant: FUJI XEROX CO., LTD., Tokyo (JP)

(72) Inventors: Kohei Takahashi, Kanagawa (JP); Suguru Goto, Kanagawa (JP); Teruki Naganuma, Kanagawa (JP); Toshikazu Takubo, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/649,244

(22) Filed: Jul. 13, 2017

(65) Prior Publication Data

US 2018/0107149 A1 Apr. 19, 2018

(30) Foreign Application Priority Data

Oct. 17, 2016 (JP) ..... 2016-203507

(51) Int. Cl.
*G03G 21/00* (2006.01)
*G03G 21/16* (2006.01)

(52) U.S. Cl.
CPC ..... *G03G 21/1633* (2013.01)

(58) Field of Classification Search
USPC ..... 399/107, 110, 124, 316
See application file for complete search history.

(56) References Cited

U.S. PATENT DOCUMENTS 5,041,872 A * 8/1991 Nukaya ..... G03G 21/1628 347/138
8,315,539 B2 * 11/2012 Uehara ..... G03G 21/1638 399/124
8,401,426 B2 3/2013 Nieda
8,820,740 B2 * 9/2014 Sugizaki ..... B65H 5/00 271/264

FOREIGN PATENT DOCUMENTS

JP 2005-163989 A 6/2005
JP 2005-208737 A 8/2005
JP 2011-53281 A 3/2011

* cited by examiner

*Primary Examiner* — Hoan Tran
(74) *Attorney, Agent, or Firm* — Oliff PLC

(57) ABSTRACT

An opening-closing mechanism includes an opening-closing panel that is rotatably supported so as to be movable between a closed position and an open position; an engagement member that is rotatably supported by the opening-closing panel; a link member that is rotatably supported by a rotating shaft provided on the apparatus body; and a guide member that is supported by a support shaft on the opening-closing panel so that the guide member is rotatable in a rotation direction and movable in a direction that crosses the rotation direction. The guide member includes a first guide surface that moves while being in contact with the link member when the opening-closing panel moves to the closed position, and a second guide surface that moves while being in contact with the link member when the opening-closing panel moves to the open position.

8 Claims, 10 Drawing Sheets

OPENING-CLOSING MECHANISM AND IMAGE FORMING APPARATUS

CROSS-REFERENCE TO RELATED APPLICATIONS

This application is based on and claims priority under 35 USC 119 from Japanese Patent Application No. 2016-203507 filed Oct. 17, 2016.

BACKGROUND

Technical Field

The present invention relates to an opening-closing mechanism and an image forming apparatus.

SUMMARY

According to an aspect of the invention, there is provided an opening-closing mechanism including an opening-closing panel that is rotatably supported so as to be movable between a closed position, at which the opening-closing panel covers an opening in an apparatus body, and an open position, at which the opening-closing panel does not cover the opening; an engagement member that is rotatably supported by the opening-closing panel and that engages with a member to be engaged provided on the apparatus body; a link member that is rotatably supported by a rotating shaft provided on the apparatus body; and a guide member that is supported by a support shaft on the opening-closing panel so that the guide member is rotatable in a rotation direction and movable in a direction that crosses the rotation direction. The guide member includes a first guide surface that moves while being in contact with the link member when the opening-closing panel moves to the closed position, and a second guide surface that moves while being in contact with the link member when the opening-closing panel moves to the open position.

BRIEF DESCRIPTION OF THE DRAWINGS

An exemplary embodiment of the present invention will be described in detail based on the following figures, wherein.

DETAILED DESCRIPTION

Figure 1:
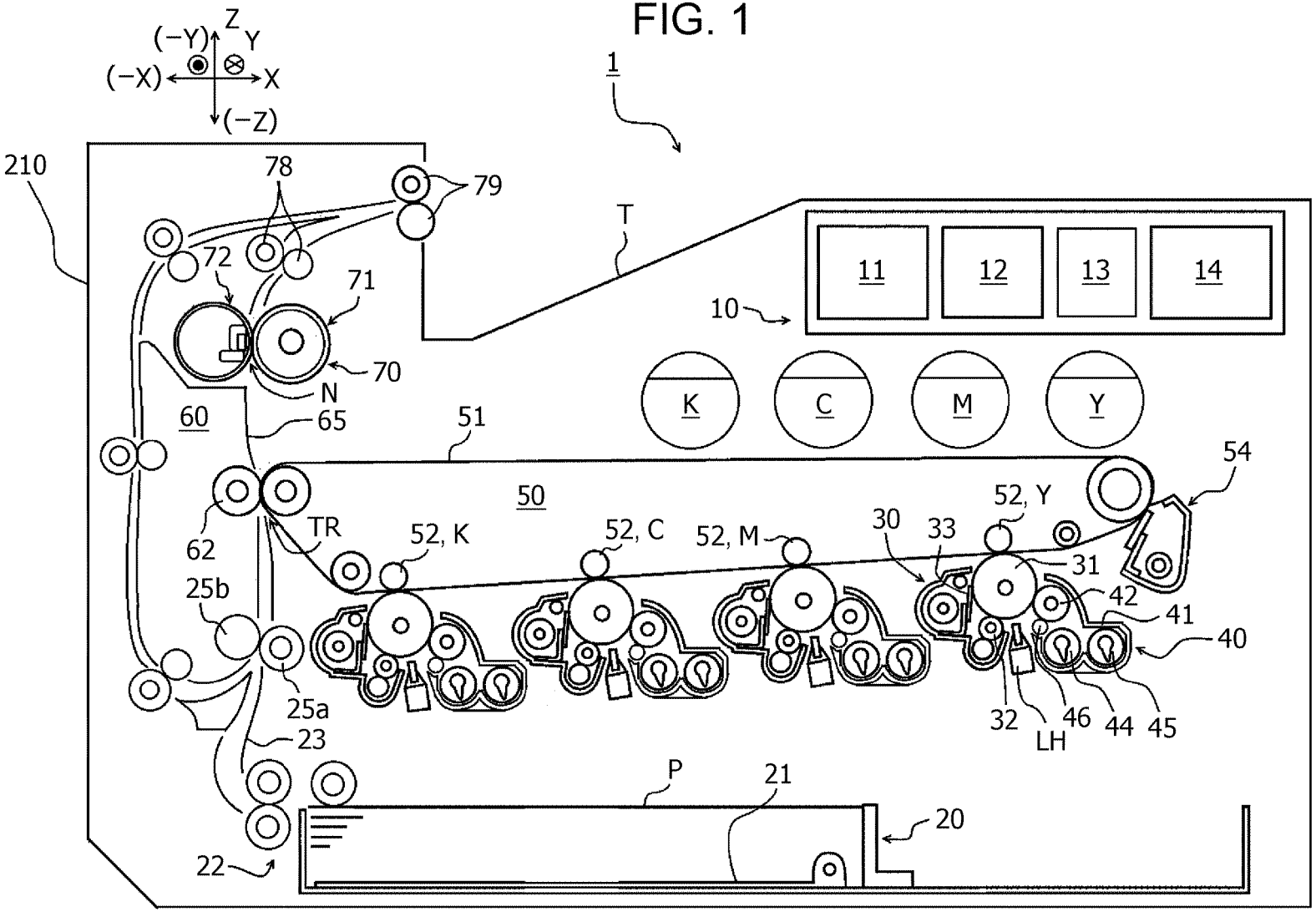
FIG. 1 is a schematic vertical sectional view illustrating the internal structure of an image forming apparatus.

The present invention will be described in further detail by way of an exemplary embodiment and examples with reference to the drawings. However, the present invention is not limited to the exemplary embodiment and examples.

It is to be noted that the drawings referred to in the following description are schematic, and that dimensional ratios, for example, in the drawings differ from the actual dimensional ratios. Components other than those necessary to be described to facilitate understanding are omitted as appropriate in the drawings.

To facilitate understanding of the following description, in the drawings, the front-rear direction is defined as the X-axis direction, the left-right direction is defined as the Y-axis direction, and the vertical direction is defined as the Z-axis direction.

(1) Overall Structure and Operation of Image Forming Apparatus

FIG. 1 is a schematic vertical sectional view illustrating the internal structure of an image forming apparatus 1 according to the present exemplary embodiment.

The overall structure and operation of the image forming apparatus 1 will be described with reference to FIG. 1.

The image forming apparatus 1 includes a control device 10, a sheet feeding device 20, photoconductor units 30, developing units 40, a transfer unit 50, a sheet transport unit 60, and a fixing unit 70, all of which are disposed in a housing 100. An output tray unit T, which receives paper sheets having images recorded thereon, is provided on the top surface (Z-direction-side surface) of the image forming apparatus 1. An opening-closing panel 210, which enables the inner region of the image forming apparatus 1 to be exposed when, for example, a jammed paper sheet P is to be removed or maintenance is to be performed, is rotatably supported on a side surface (−X-direction-side surface) of the image forming apparatus 1.

The control device 10 includes an image-forming-apparatus controller 11 that controls the operation of the image forming apparatus 1; a controller unit 12 that prepares image data corresponding to a print request; an exposure controller 13 that controls the on-off state of exposure heads LH; and a power supply device 14. The power supply device 14 applies a high voltage to, for example, charging rollers 32, developing rollers 42, first transfer rollers 52, and a second transfer roller 62, which will be described below, and supplies electric power to, for example, the exposure heads LH, the sheet feeding device 20, the fixing unit 70, and various sensors.

The controller unit 12 converts print information input thereto from an external information transmission device (for example, a personal computer) into image information used to form latent images, and outputs drive signals to the exposure heads LH at a preset timing. Each of the exposure heads LH according to the present exemplary embodiment includes an LED head in which plural light emitting diodes (LEDs) are linearly arranged in a scanning direction.

The sheet feeding device 20 is disposed in a bottom section of the image forming apparatus 1. The sheet feeding device 20 includes a sheet stacking plate 21. Multiple paper sheets P, which serve as recording media, are stacked on the top surface of the sheet stacking plate 21. The paper sheets P stacked on the sheet stacking plate 21 are fed forward (in the −X direction) one at a time from the top by a sheet-feeding unit 22, and then transported to a nip portion of a registration roller pair 25, which includes a driving roller 25*a* and a driven roller 25*b*, through a sheet guide 23.

The photoconductor units 30 are arranged next to each other above (on the Z-direction side of) the sheet feeding device 20. Each photoconductor unit 30 includes a photoconductor drum 31 around which a charging roller 32, an exposure head LH, a developing unit 40, a first transfer roller 52, and a cleaning blade 33 are arranged in the rotation direction of the photoconductor drum 31.

Each developing unit 40 includes a developing housing 41 that contains developer. The developing housing 41 houses a developing roller 42 that opposes the photoconductor drum 31, and a pair of augers 44 and 45 that are disposed behind and below the developing roller 42 and that transport the developer toward the developing roller 42 while stirring the developer. A layer-thickness regulating member 46, which regulates the layer thickness of the developer, is disposed near the developing roller 42.

The developing units 40 have substantially the same structure except for the developers contained in the developing housings 41 thereof, and form yellow (Y), magenta (M), cyan (C), and black (K) toner images.

The surface of each photoconductor drum 31 that rotates is charged by the charging roller 32, and an electrostatic latent image is formed thereon by latent image-forming light emitted from the exposure head LH. The electrostatic latent image formed on the photoconductor drum 31 is developed into a toner image by the developing roller 42.

The transfer unit 50 includes an intermediate transfer belt 51 and the first transfer rollers 52. The toner images of the respective colors formed on the photoconductor drums 31 of the photoconductor units 30 are transferred onto the intermediate transfer belt 51 in a superposed manner. The first transfer rollers 52 successively transfer the toner images of the respective colors formed by the photoconductor units 30 onto the intermediate transfer belt 51 (first transfer process). The transfer unit 50 also includes an intermediate-transfer-belt cleaner 54 that removes residual toner that remains on the intermediate transfer belt 51.

The sheet transport unit 60 includes the driven roller 25*b* of the registration roller pair 25, which corrects the orientation of the paper sheet P fed from the sheet feeding device 20 and transports the paper sheet P to a second transfer region TR in accordance with the timing of a second transfer process. The sheet transport unit 60 also includes the second transfer roller 62, which simultaneously transfers the toner images of the respective colors that have been transferred onto the intermediate transfer belt 51 onto the paper sheet P, which is a recording medium (second transfer process) in a superposed manner. The paper sheet P to which the toner images have been transferred is guided to a fixing nip portion N of the fixing unit 70 by a transport guide 65.

The toner images of the respective colors formed on the photoconductor drums 31 of the photoconductor units 30 are successively electrostatically transferred onto the intermediate transfer belt 51 by the first transfer rollers 52, which receive a predetermined transfer voltage from, for example, the power supply device 14 controlled by the image-forming-apparatus controller 11 (first transfer process). Thus, a superposed toner image in which the toner images of the respective colors are superposed is formed.

The superposed toner image on the intermediate transfer belt 51 is transported toward the second transfer region TR as the intermediate transfer belt 51 is moved. The paper sheet P is supplied to the second transfer region TR from the registration roller pair 25 in accordance with the timing at which the superposed toner image is transported to the second transfer region TR.

The second transfer roller 62 receives a predetermined transfer voltage from, for example, the power supply device 14 controlled by the image-forming-apparatus controller 11, so that the superposed toner image on the intermediate transfer belt 51 is transferred onto the paper sheet P fed from the registration roller pair 25.

The residual toner on the surface of each photoconductor drum 31 is removed by the cleaning blade 33 and collected in a waste toner container (not shown). The surface of the photoconductor drum 31 is charged again by the charging roller 32.

The fixing unit 70 includes a heating module 71 and a pressing module 72, and a fixing nip portion N (fixing region) is formed in the region where the heating module 71 and the pressing module 72 are pressed against each other. The paper sheet P onto which the toner image has been transferred in the second transfer region TR is transported to the fixing unit 70 along the transport guide 65 while the toner image is not fixed. The paper sheet P transported to the fixing unit 70 is heated and pressed by the heating module 71 and the pressing module 72, so that the toner image is fixed thereto by the heat and pressure.

The paper sheet P on which the fixed toner image is formed is discharged to the output tray unit T on the top surface of the image forming apparatus 1 through a pair of transport rollers 78 and a pair of output rollers 79. In the case where duplex printing is performed, the pair of output rollers 79 are driven in the reverse direction after the trailing end of the paper sheet P with an image fixed on the front side thereof has passed the pair of transport rollers 78. The paper sheet P is transported to the registration roller pair 25 along a reverse transport path formed in the opening-closing panel 210, and an image is formed on the back side thereof.

(2) Structure and Operation of Sheet Transport Section

Figure 2:
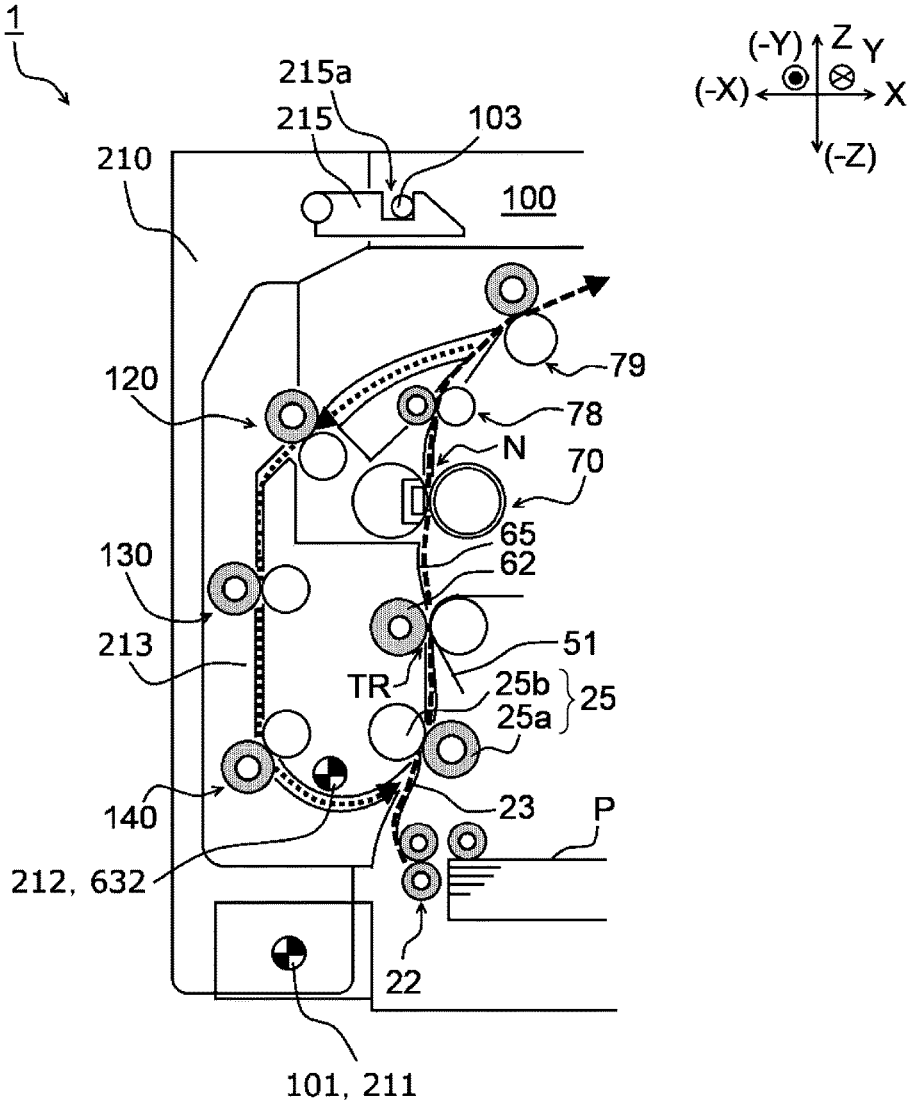
FIG. 2 is a schematic sectional view illustrating the internal structure of a sheet transport section and a sheet transporting operation.
Figure 3:
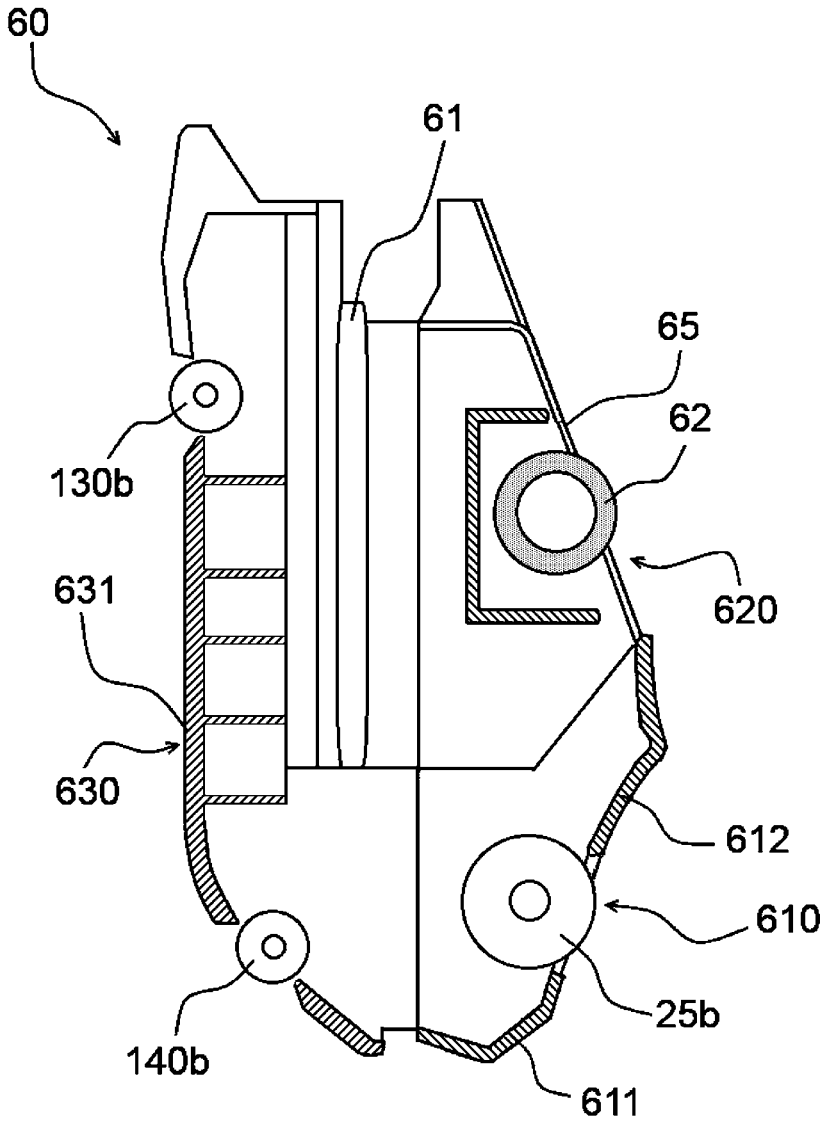
FIG. 3 is a schematic sectional view of a sheet transport unit.
Figure 4A:
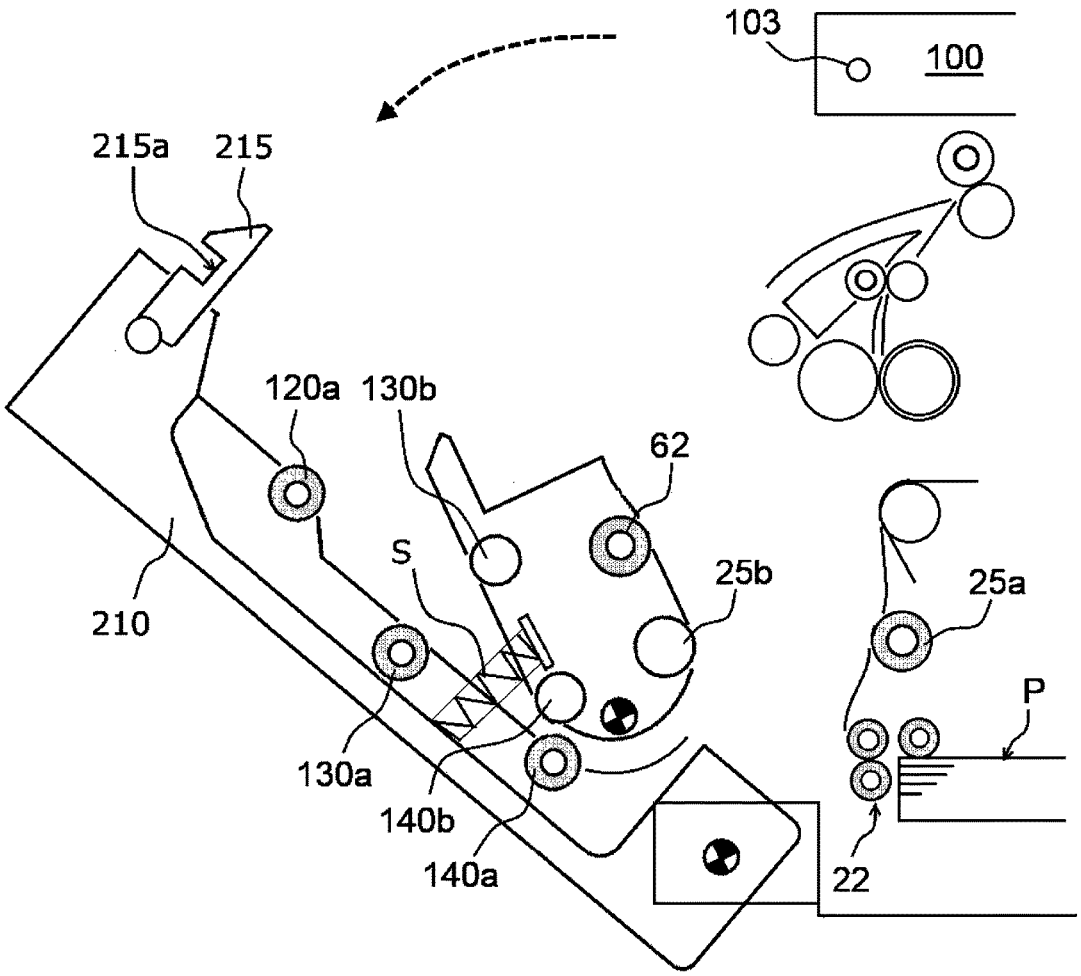
FIG. 4A is a schematic diagram illustrating the positional relationship between an opening-closing panel and the sheet transport unit when the sheet transport section is opened.
Figure 4B:
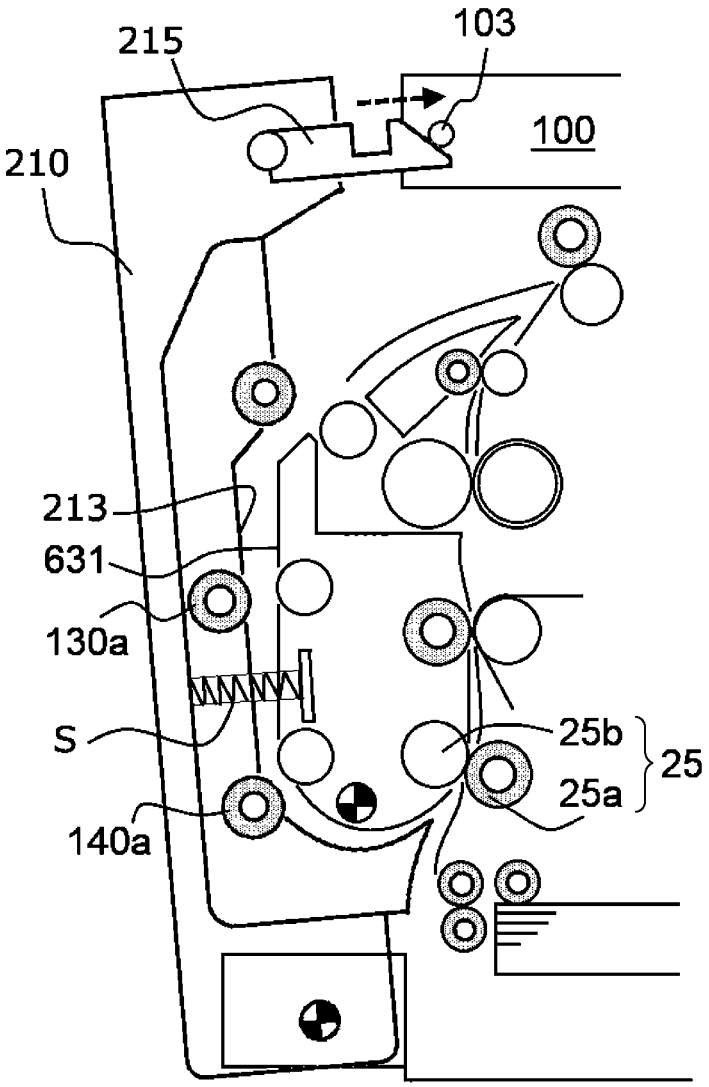
FIG. 4B is a schematic diagram of the sheet transport section illustrating the movement of the sheet transport unit during a closing operation of the opening-closing panel.
Figure 5A:
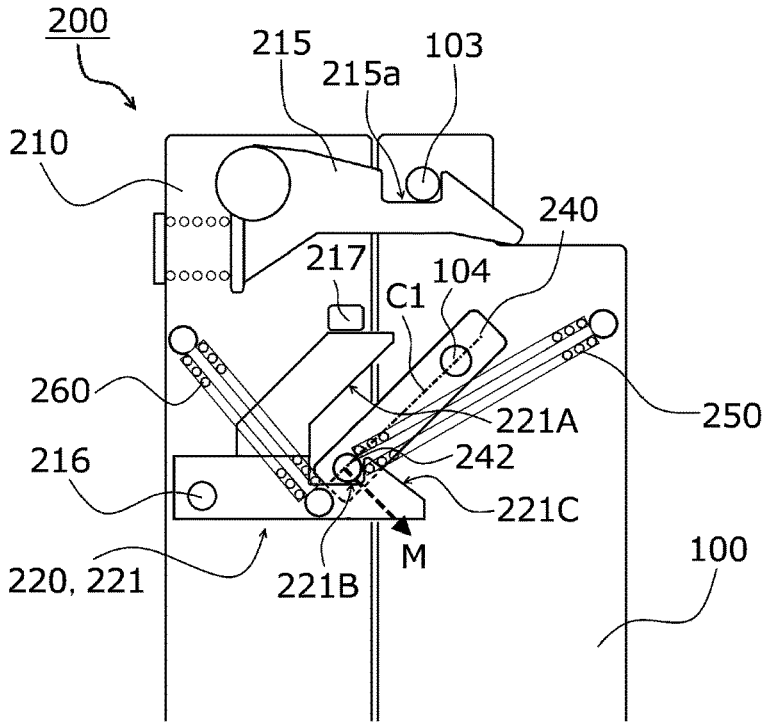
FIG. 5A is a schematic diagram illustrating a state where a first guide surface of a guide member is engaged with a link member, wherein a second guide surface is omitted.
Figure 5B:
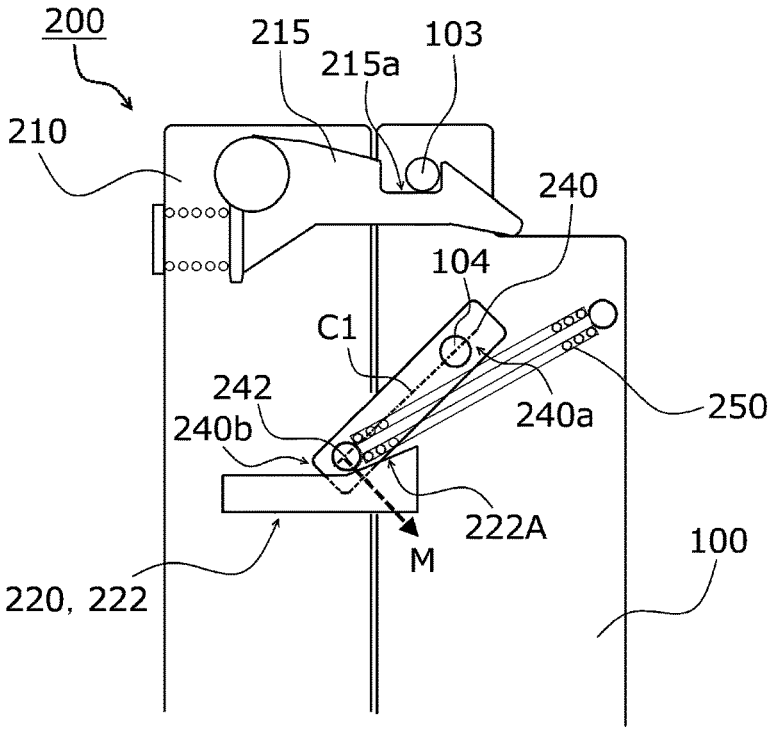
FIG. 5B is a schematic diagram illustrating a state where the second guide surface of the guide member is in contact with the link member, wherein the first guide surface is omitted.
Figure 6A:
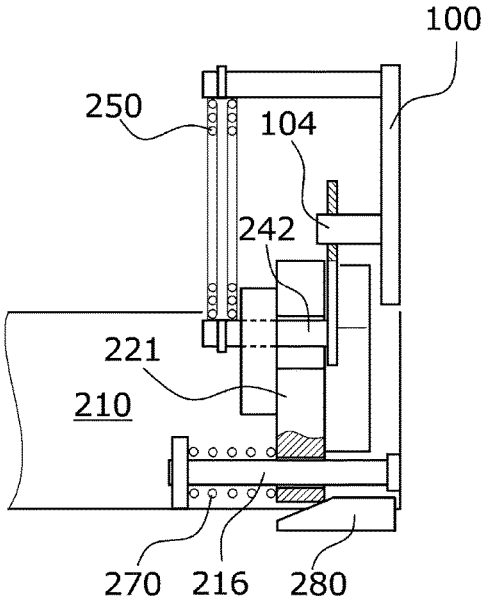
FIG. 6A is a schematic plan view illustrating engagement between the first guide surface of the guide member and a stud of the link member.
Figure 6B:
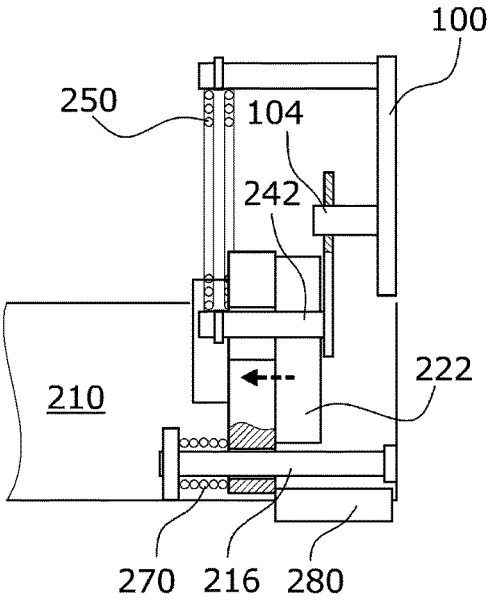
FIG. 6B is a schematic plan view illustrating engagement between the second guide surface of the guide member and the stud of the link member.

FIG. 2 is a schematic sectional view illustrating the internal structure of a sheet transport section and a sheet transporting operation. FIG. 3 is a schematic sectional view of the sheet transport unit 60. FIG. 4A is a schematic diagram illustrating the positional relationship between the opening-closing panel 210 and the sheet transport unit 60 when the sheet transport section is opened. FIG. 4B is a schematic diagram of the sheet transport section illustrating the movement of the sheet transport unit 60 during a closing operation of the opening-closing panel 210. FIG. 5A is a schematic diagram illustrating a state where a first guide surface 221 of a guide member 220 is engaged with a link member 240, wherein a second guide surface 222 is omitted. FIG. 5B is a schematic diagram illustrating a state where the second guide surface 222 of the guide member 220 is in contact with the link member 240, wherein the first guide surface 221 is omitted. FIG. 6A is a schematic plan view illustrating engagement between the first guide surface 221 of the guide member 220 and a stud 242 of the link member 240. FIG. 6B is a schematic plan view illustrating engagement between the second guide surface 222 of the guide member 220 and the stud 242 of the link member 240.

The structure and operation of the sheet transport section of the image forming apparatus 1 will now be described with reference to the drawings.

The sheet transport section is constituted by the housing 100, an opening-closing mechanism 200 including the opening-closing panel 210, and the sheet transport unit 60.

(2.1) Housing

The housing 100 has an opening at a side thereof (side in the −X direction), and houses the photoconductor units 30, the developing units 40, and the transfer unit 50.

Bearings 101, which serve as a rotational center of the opening-closing panel 210, are provided at the bottom end of the opening in the housing 100. The bearings 101 support rotating shafts 211 of the opening-closing panel 210, which will be described below, in a rotatable manner.

Lock pins 103 are provided near the opening on an upper section of the housing 100. Each lock pin 103 projects in a direction that crosses the direction in which the opening-closing panel 210 is opened and closed.

Each lock pin 103 engages with a recess 215*a* in a latch lever 215 that is rotatably provided on an upper section of the opening-closing panel 210. Thus, the opening-closing panel 210 is secured to the housing 100 in such a manner the opening is covered with the opening-closing panel 210.

(2.2) Opening-Closing Panel

The opening-closing panel 210 supports the sheet transport unit 60 therein in a rotatable manner. The rotating shafts 211 of the opening-closing panel 210 are supported by the bearings 101 on the housing 100 so that the opening-closing panel 210 is rotatable between a closed position, at which the opening-closing panel 210 covers the opening in the housing 100, and an open position, at which the opening-closing panel 210 does not cover the opening.

An outer transport guide 213 is formed on the inner surface of the opening-closing panel 210 that opposes the housing 100. The outer transport guide 213 serves as one wall of the reverse transport path along which the paper sheet P is transported to the registration roller pair 25 again after an image is fixed to the front side thereof and the transporting direction thereof is reversed.

The outer transport guide 213 and an inner transport guide 631, which is formed on the sheet transport unit 60, are arranged with a predetermined gap therebetween to define the reverse transport path.

Plural transport roller pairs 120, 130, and 140 are arranged along the reverse transport path. The transport roller pairs 120, 130, and 140 include driving transport rollers 120*a*, 130*a*, and 140*a*, which are arranged along the outer transport guide 213.

(2.3) Sheet Transport Unit

The sheet transport unit 60 includes a registration unit 610, a second transfer unit 620, and a duplex printing unit 630.

The registration unit 610 includes a first sheet guide 611, the driven roller 25*b* of the registration roller pair 25, and a second sheet guide 612. The driving roller 25*a* of the registration roller pair 25 is disposed in the apparatus body.

The first sheet guide 611 guides the paper sheet P to the nip portion of the registration roller pair 25 after the paper sheet P is fed from the sheet feeding device 20 or transported by the duplex printing unit 630. The second sheet guide 612 guides the paper sheet P to the second transfer region TR after the paper sheet P, whose orientation is corrected, is fed from the registration roller pair 25.

The second transfer unit 620 includes the second transfer roller 62 and the transport guide 65. The paper sheet P is transported to the second transfer unit 620 in accordance with the timing of the second transfer process. The second transfer unit 620 simultaneously transfers the toner images on the intermediate transfer belt 51 onto the paper sheet P by using the second transfer roller 62, which is urged against the intermediate transfer belt 51 (second transfer process). The paper sheet P to which the toner images have been transferred is guided to the fixing nip portion N of the fixing unit 70 by the transport guide 65.

The duplex printing unit 630 includes the inner transport guide 631, which opposes the outer transport guide 213 formed on the inner surface of the opening-closing panel 210 and serves as the other wall of the reverse transport path. The duplex printing unit 630 transports the paper sheet P to be subjected to duplex printing to the registration roller pair 25.

A pinch roller 130*b* included in the transport roller pair 130 and a pinch roller 140*b* included in the transport roller pair 140 are rotatably arranged along the inner transport guide 631.

A pair of left and right rotating shaft portions 632 are provided at the bottom of the inner transport guide 631. The rotating shaft portions 632 are inserted in bearings 212 provided on both side plates of the opening-closing panel 210, so that the sheet transport unit 60 is rotatably supported by the opening-closing panel 210.

Referring to FIGS. 4A and 4B, one end of a compression coil spring S is fixed to the inner transport guide 631 at each side thereof. The other end of the compression coil spring S is fixed to an inner surface of the opening-closing panel 210 that opposes the inner transport guide 631. Thus, when the opening-closing panel 210 is secured at the closed position, urging force of the compression coil spring S is applied between the sheet transport unit 60 and the opening-closing panel 210.

Accordingly, when the opening-closing panel 210 is moved to the open position, the sheet transport unit 60 is rotated as the opening-closing panel 210 is moved, so that the nip of the registration roller pair 25 is disengaged, and the nip between the second transfer roller 62 and the intermediate transfer belt 51 in the second transfer region TR is also disengaged.

In addition, the inner transport guide 631 and the outer transport guide 113, which form the reverse transport path, are released from each other by the urging force of the compression coil spring S, so that the nip of each of the transport roller pairs 120, 130, and 140 is also disengaged.

To return the opening-closing panel 210 from the open position to the closed position, the opening-closing panel 210 is rotated toward the housing 100.

As the opening-closing panel 210 is rotated toward the housing 100, the sheet transport unit 60 is also rotated toward the housing 100, and receives reaction force of the nip of the registration roller pair 25 and the nip of the second transfer roller 62 in the second transfer region TR. In this state, the recess 215*a* in the latch lever 215 engages with the lock pin 103, so that the opening-closing panel 210 is secured.

(2.4) Opening-Closing Mechanism

The opening-closing mechanism 200 includes the opening-closing panel 210; the guide member 220 disposed on the opening-closing panel 210; the latch lever 215 that serves as an engagement member that engages with the lock pin 103 provided on the housing 100 as a member to be engaged; the link member 240 disposed on the housing 100; a tension coil spring 250 as an example of a first elastic member that applies a rotational moment M to the link member 240; a tension coil spring 260 as an example of a second elastic member attached to the guide member 220; a compression coil spring 270 that urges the guide member 220 in such a manner that the guide member 220 is movable in an axial direction of a support shaft 216; and a swash plate cam 280 that moves the guide member 220 in the axial direction of the support shaft 216 in response to the rotation of the latch lever 215.

The guide member 220 is rotatably supported by the support shaft 216 at a location below the latch lever 215 in an upper section of the opening-closing panel 210. The guide member 220 is in contact with with an abutting portion 217 provided on the opening-closing panel 210 so that rotation thereof is regulated while one end thereof is connected to the tension coil spring 260.

The guide member 220 includes the first guide surface 221 and the second guide surface 222. As illustrated in FIG. 5A, the first guide surface 221 moves while being in contact with the link member 240, which will be described below, when the opening-closing panel 210 is moved to the closed position. As illustrated in FIG. 5B, the second guide surface 222 moves while being in contact with the link member 240 when the opening-closing panel 210 is moved to the open position.

As illustrated in FIG. 6A, when the latch lever 215 is engaged with the lock pin 103 so that the opening-closing panel 210 is locked at the closed position, the guide member 220 is urged toward the link member 240 by the compression coil spring 270 and the first guide surface 221 is engaged with the stud 242 of the link member 240. When the latch lever 215 is rotated to move the opening-closing panel 210 to the open position, the guide member 220 is pushed in the axial direction of the support shaft 216 by the swash plate cam 280 so that the second guide surface 222 is moved to a position where the second guide surface 222 comes into contact with the stud 242 of the link member 240 (see the arrow in FIG. 6B).

The first guide surface 221 includes a first inclined portion 221A that receives the stud 242 of the link member 240 when the opening-closing panel 210 is moved to the closed position; a hook portion 221B with which the stud 242 of the link member 240 engages to pull the guide member 220; and a second inclined portion 221C formed in front of the hook portion 221B and inclined in a direction opposite to the direction in which the first inclined portion 221A is inclined.

When the stud 242 of the link member 240 guided by the first inclined portion 221A passes the top dead center at an end point 221Ab (see FIG. 7B) of the first inclined portion 221A, the hook portion 221B receives the rotational moment M applied to the link member 240 in the reversed direction. Accordingly, the opening-closing panel 210 receives a pulling force in a direction toward the housing 100, and the operating force for moving the opening-closing panel 210 to the closed position is reduced.

The second guide surface 222 is formed integrally with the first guide surface 221 at one side of the first guide surface 221, and includes an inclined surface 222A that is inclined in a direction that crosses the direction in which the opening-closing panel 210 is moved.

When the opening-closing panel 210 is moved from the closed position to the open position, the second guide surface 222 moves along the axis of the support shaft 216 in response to the rotation of the latch lever 215. The second guide surface 222 comes into contact with the stud 242 of the link member 240 that receives the rotational moment M in the reversed direction, and rotates the link member 240 so that the direction of the rotational moment M is reversed again.

A proximal portion 240*a* of the link member 240 is rotatably supported by a rotating shaft 104 provided on the housing 100. A distal portion 240*b* of the link member 240 includes the stud 242, which projects in a direction that crosses the rotation direction, and the tension coil spring 250 is attached to the stud 242. Accordingly, the link member 240 receives the rotational moment M of the first tension coil spring 250 (see arrow M in FIGS. 5A and 5B). The direction of the rotational moment M switches between clockwise and counterclockwise at the top dead center, which is the position where the direction in which the tension coil spring 250 extends coincides with an imaginary line C1 connecting the rotating shaft 104 and the stud 242.

(3) Opening-Closing Operation of Opening-Closing Panel

Figure 7A:
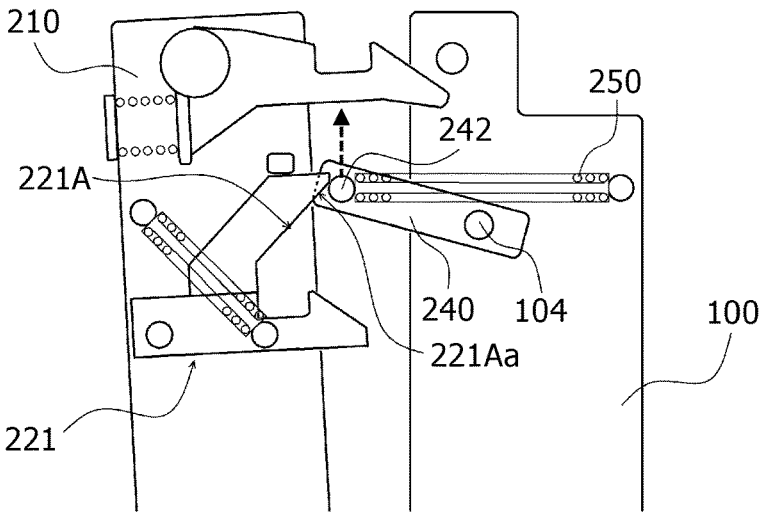
FIGS. 7A to 7C are schematic diagrams illustrating a pulling operation performed on the opening-closing panel by the link member when the opening-closing panel is moved to a closed position.
Figure 7B:
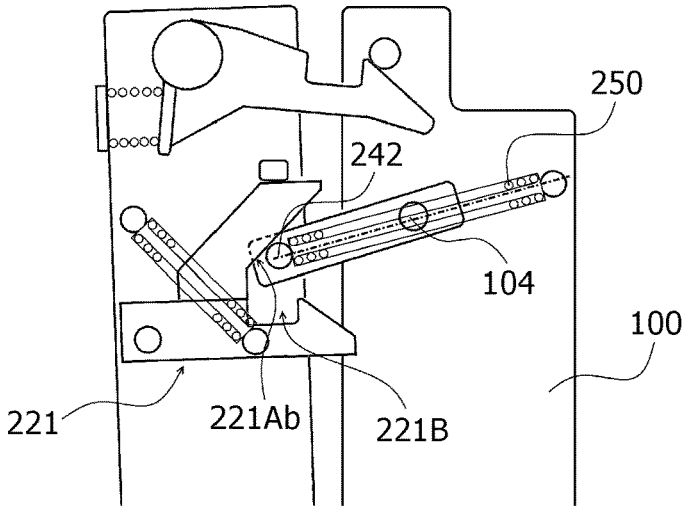
Figure 7C:
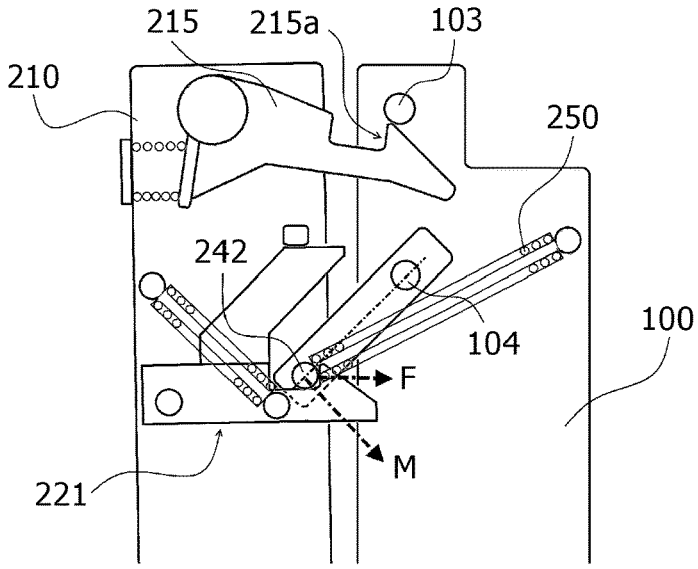
Figure 8A:
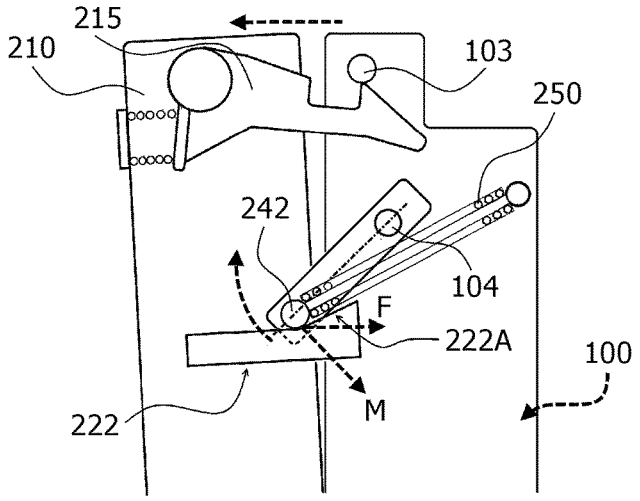
FIGS. 8A to 8C are schematic diagrams illustrating a returning operation of the link member performed when the opening-closing panel is moved to an open position.
Figure 8B:
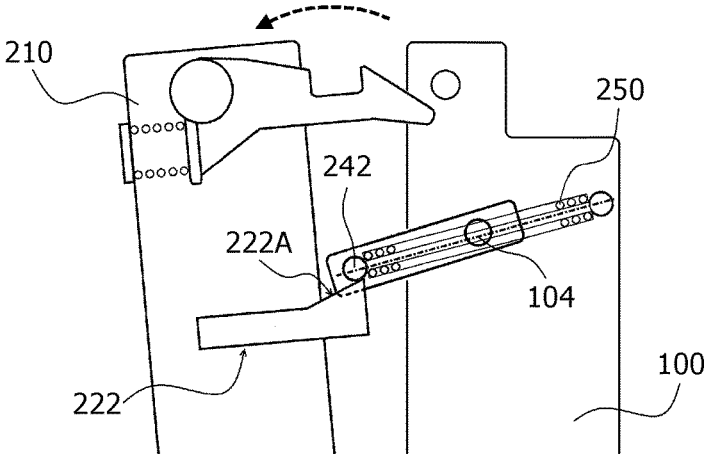
Figure 8C:
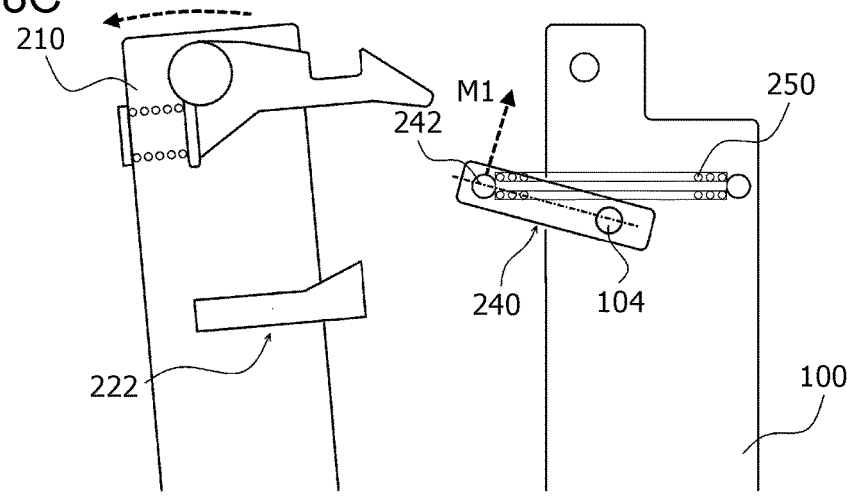
Figure 9A:
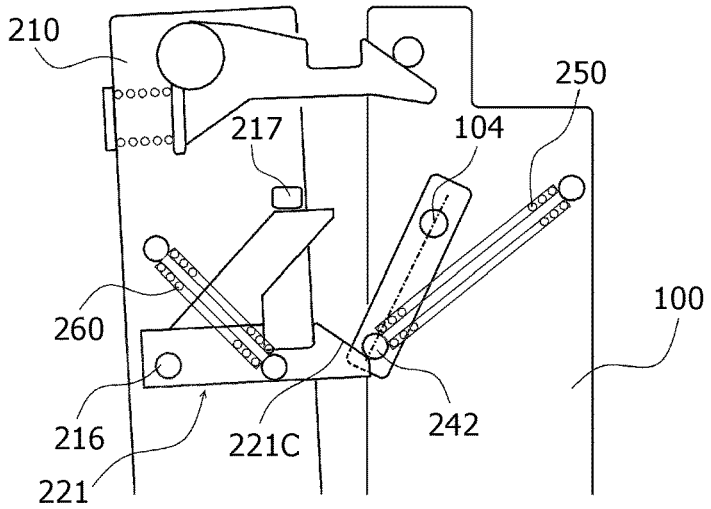
FIGS. 9A to 9C are schematic diagrams illustrating a returning operation of the link member performed when the opening-closing panel is moved to the closed position while the link member is at a position for the pulling operation.
Figure 9B:
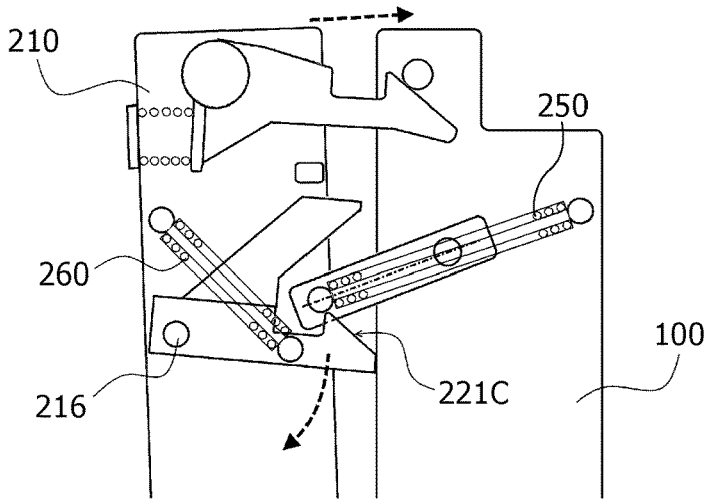
Figure 9C:
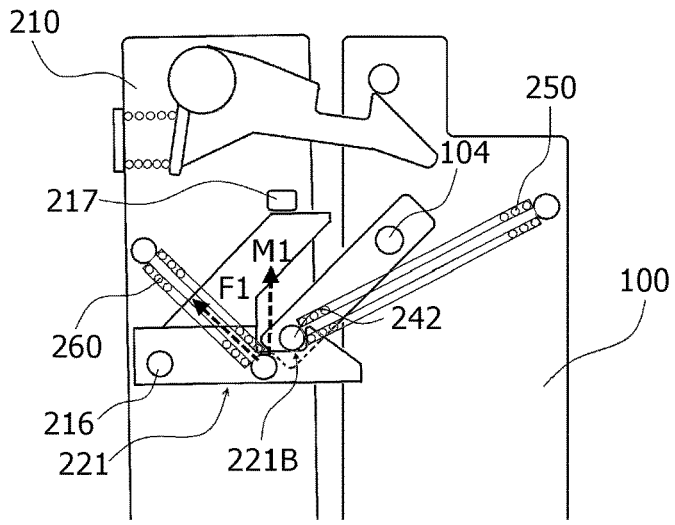

FIGS. 7A to 7C are schematic diagrams illustrating a pulling operation performed on the opening-closing panel 210 by the link member 240 when the opening-closing panel 210 is moved to the closed position. FIGS. 8A to 8C are schematic diagrams illustrating a returning operation of the link member 240 performed when the opening-closing panel 210 is moved to the open position. FIGS. 9A to 9C are schematic diagrams illustrating the returning operation performed when the opening-closing panel 210 is moved to the closed position while the link member 240 is at a position for the pulling operation. The operation of the opening-closing mechanism 200 will now be described with reference to the drawings.

(3.1) Closing Operation of Opening-Closing Panel

When the opening-closing panel 210 is rotated toward the housing 100 to return the opening-closing panel 210 from the open position to the closed position, the guide member 220 on the opening-closing panel 210 is also rotated toward the housing 100. Accordingly, the stud 242 of the link member 240 provided on the housing 100 comes into contact with the first inclined portion 221A of the first guide surface 221 at the start point 221Aa (see FIG. 7A).

When the opening-closing panel 210 is further rotated toward the closed position, the stud 242 of the link member 240 is rotated along the movement path of the first inclined portion 221A of the first guide surface 221, and reaches the top dead center at the end point 221Ab of the first inclined portion 221A, so that the rotational moment M is eliminated (see FIG. 7B).

When the stud 242 of the link member 240 reaches the top dead center, the direction of the rotational moment M is reversed and the stud 242 engages with the hook portion 221B of the first guide surface 221.

The guide member 220 receives the rotational moment M applied to the link member 240 in the reversed direction while the hook portion 221B is engaged with the stud 242. Accordingly, the opening-closing panel 210 receives a pulling force F toward the closed position based on the rotational moment M applied to the link member 240 in the reversed direction (see FIG. 7C).

Therefore, the operating force may be reduced by partially compensating for the reaction force of the nip of the registration roller pair 25 and the nip of the second transfer roller 62.

When the opening-closing panel 210 is further rotated toward the closed position, the guide member 220 is pulled toward the closed position by the link member 240, and the link member 240 reaches the closed position. Then, the recess 215*a* in the latch lever 215 engages with the lock pin 103 on the housing 100, so that the opening-closing panel 210 is secured at the closed position (see FIG. 5A).

(3.2) Opening Operation of Opening-Closing Panel

When the opening-closing panel 210 is to be moved from the closed position to the open position, the latch lever 215 disposed in the upper section of the opening-closing panel 210 is pulled upward and released from the lock pin 103 on the housing 100. Then, the opening-closing panel 210 is rotated sideways away from the body of the image forming apparatus 1 (in the −X direction in FIG. 1).

As illustrated in FIG. 6B, when the opening-closing panel 210 is locked at the closed position, the guide member 220 is pushed by the swash plate cam 280 in response to the rotation of the latch lever 215 and moves along the axis of the support shaft 216 so that the second guide surface 222 comes into contact with the stud 242 of the link member 240 (see FIG. 5B).

When the rotation of the opening-closing panel 210 is started, the stud 242 of the link member 240 rotates along the inclined surface 222A of the second guide surface 222 of the guide member 220. Since the inclined surface 222A has a small inclination angle relative to the direction in which the opening-closing panel 210 is moved, a force is applied in the same direction as the direction of the pulling force F based on the rotational moment M (see FIG. 8A). Thus, an increase in the operating force in the opening operation of the opening-closing panel 210 is suppressed.

When the opening-closing panel 210 is further rotated, the stud 242 of the link member 240 rotates along the inclined surface 222A and reaches the top dead center, so that the rotational moment M is eliminated (see FIG. 8B).

Then, as the opening-closing panel 210 is rotated, the direction of the rotational moment M applied to the link member 240 is reversed, and the link member 240 returns to a standby position to wait for the rotation of the opening-closing panel 210 toward the closed position (see FIG. 8C).

When the opening-closing panel 210 is returned from the open position to the closed position, the link member 240 on the housing 100 is rotated along the first inclined portion 221A of the first guide surface 221 of the guide member 220. The direction of the rotational moment M is reversed at the end point 221Ab of the first inclined portion 221A, so that the opening-closing panel 210 receives the pulling force F from the link member 240 and the operating force is reduced.

When the opening-closing panel 210 is moved from the closed position to the open position, the link member 240, which assists the closing operation of the opening-closing panel 210, rotates along a surface different from that in the closing operation, that is, along the inclined surface 222A of the second guide surface 222 that has a small inclination angle. Thus, an increase in the operating force is suppressed in the opening operation.

(3.3) Closing Operation of Opening-Closing Panel

When the opening-closing panel 210 is open, there is a risk that the link member 240 will be switched from the normal standby position to the position for the pulling operation due to, for example, operational errors. In the opening-closing mechanism 200 according to the present exemplary embodiment, when the opening-closing panel 210 is closed after the link member 240 has been switched to the position for the pulling operation, the second inclined portion 221C of the first guide surface 221 of the guide member 220 rotates while being in contact with the stud 242 of the link member 240 and returns the link member 240 to a normal position for the closing operation.

When the opening-closing panel 210 is rotated toward the housing 100 to return the opening-closing panel 210 from the open position to the closed position, the guide member 220 on the opening-closing panel 210 is also rotated toward the housing 100. Accordingly, the stud 242 of the link member 240 that has been switched from the normal standby position to the position for the pulling operation comes into contact with the second inclined portion 221C of the first guide surface 221 (see FIG. 9A).

Then, when the opening-closing panel 210 is further rotated toward the closed position, the stud 242 of the link member 240 rotates along the second inclined portion 221C of the first guide surface 221, and the guide member 220 rotates around the support shaft 216 while being pressed downward by the stud 242 of the link member 240.

When the opening-closing panel 210 is further rotated toward the closed position, the stud 242 of the link member 240 is further rotated along the second inclined portion 221C of the first guide surface 221 (see the arrow in FIG. 9B), and the rotational moment M applied to the stud 242 of the link member 240 is reduced. The rotational moment M is eliminated at the top dead center (see FIG. 9B).

The guide member 220 receives a rotational moment M1 based on a pulling force F1 applied by the tension coil spring 260 that has been stretched in response to the rotation of the guide member 220, so that the rotation direction of the guide member 220 is reversed. As a result, the stud 242 of the link member 240 that is in contact with the second inclined portion 221C engages with the hook portion 221B of the first guide surface 221, and the link member 240 stops at the normal position for the closing operation of the opening-closing panel 210. The guide member 220 comes into contact with the abutting portion 217 and stops (see FIG. 9C).

Thus, even when the link member 240 has been switched from the normal standby position to the position for the pulling operation due to, for example, operational errors, the second inclined portion 221C of the first guide surface 221 of the guide member 220 rotates while being in contact with the stud 242 of the link member 240 and returns the link member 240 to the normal position for the closing operation. As a result, interference between the link member 240 and the opening-closing panel 210 is suppressed and the opening-closing panel 210 may be reliably closed.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An opening-closing mechanism comprising:

an opening-closing panel that is rotatably supported so as to be movable between a closed position, at which the opening-closing panel covers an opening in an apparatus body, and an open position, at which the opening-closing panel does not cover the opening;

an engagement member that is rotatably supported by the opening-closing panel and that engages with a member to be engaged provided on the apparatus body;

a link member that is rotatably supported by a rotating shaft provided on the apparatus body; and a guide member that is supported by a support shaft on the opening-closing panel so that the guide member is rotatable in a rotation direction and movable in a direction that crosses the rotation direction, the guide member including:

a first guide surface configured to move while being in contact with the link member when the opening-closing panel moves to the closed position, and a second guide surface adjacent to the first guide surface in the direction that crosses the rotation direction, the second guide surface being configured to move while being in contact with the link member when the opening-closing panel moves to the open position.

2. The opening-closing mechanism according to claim 1, wherein a first elastic member is attached to a distal end portion of the link member, and the link member rotates around the rotating shaft while receiving a rotational moment.

3. The opening-closing mechanism according to claim 2, wherein during movement of the opening-closing panel from the open position to the closed position, a direction of the rotational moment is reversed when the distal end portion of the link member, to which the first elastic member is attached, passes beyond a top dead center, and the link member pulls the guide member in a moving direction of the opening-closing panel.

4. The opening-closing mechanism according to claim 3, wherein a second elastic member is attached to one end portion of the guide member, and the guide member rotates around the support shaft.

5. The opening-closing mechanism according to claim 4, wherein during movement of the opening-closing panel from the open position to the closed position, if the guide member comes into contact with the link member in such a state that the direction of the rotational moment has been reversed, the guide member rotates around the support shaft and engages with the link member.

6. The opening-closing mechanism according to claim 3, wherein:

the second guide surface includes an inclined surface inclined in a direction that crosses a moving direction of the opening-closing panel, and during movement of the opening-closing panel from the closed position to the open position, the second guide surface moves along an axis of the support shaft so as to come into contact with the link member in such a state that the direction of the rotational moment has been reversed, and rotates the link member so that the direction of the rotational moment is reversed again.

7. The opening-closing mechanism according to claim 1, wherein the guide member moves in a direction that crosses the rotation direction in response to a rotation operation for disengaging the engagement member.

8. An image forming apparatus comprising:

an image forming unit that forms an image on a paper sheet;

a sheet transport section that transports the paper sheet to the image forming unit; and the opening-closing mechanism according to claim 1.

* * * * *